US006559877B2

(12) United States Patent
Miyano

(10) Patent No.: US 6,559,877 B2
(45) Date of Patent: May 6, 2003

(54) THERMAL TRANSFER PRINTER

(75) Inventor: Tsuyoshi Miyano, Sunnyvale, CA (US)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/952,905

(22) Filed: Sep. 13, 2001

(65) Prior Publication Data

US 2003/0048347 A1 Mar. 13, 2003

(51) Int. Cl.[7] ..... B41J 2/34
(52) U.S. Cl. ..... 347/200
(58) Field of Search ..... 347/200, 218, 347/206–207, 220, 208, 215, 197; 271/275, 277; 219/543; 29/611

(56) References Cited

U.S. PATENT DOCUMENTS 4,849,605 A * 7/1989 Nakamori et al. ..... 219/543
5,095,318 A * 3/1992 Sugiyama ..... 347/207
5,357,271 A * 10/1994 Wiklof et al. ..... 347/197
5,594,488 A * 1/1997 Tsushima et al. ..... 347/208
6,151,054 A * 11/2000 Shimizu ..... 347/200
6,407,764 B1 * 6/2002 Susukida et al. ..... 29/611

* cited by examiner

*Primary Examiner*—Lamson Nguyen
*Assistant Examiner*—K. Feggins
(74) *Attorney, Agent, or Firm*—Beyer Weaver & Thomas, LLP

(57) ABSTRACT

A thermal printer for transferring ink from an ink film to a printing medium is described. The thermal transfer printer includes a print head and a platen. The print head has a plurality of resistance heating elements operable to be individually energized with electrical drive pulses. Each of the resistance heating elements has a transfer surface which is substantially flat for transfer of the ink from the ink film to the printing medium. The print head is pressed against the platen during printing. At least one of the transfer surfaces includes a concave portion which substantially avoids the transfer of the ink.

12 Claims, 3 Drawing Sheets

THERMAL TRANSFER PRINTER

BACKGROUND OF THE INVENTION

The present invention relates to printers, and more specifically, to apparatus and methods for printing by transferring ink from an ink film to a printing medium.

Thermal transfer printers are used for printing various documents with high resolution and full colors. When a thermal transfer printer prints documents of value, e.g., original tickets, gift certificates, postage stamps, and the like, there is a need to avoid counterfeiting of the documents. Security measures against counterfeiting include use of special ink (e.g., ultraviolet ink) and watermarked paper. For example, some hidden images are printed using special ink before other visible images are printed using regular color ink. Alternatively, images are printed on watermarked paper using regular black ink.

However, these security measures pose some problems. First, the cost of special ink or watermarked paper is high compared to regular ink or paper. Second, use of special ink would incur an additional mechanism and step because printing conditions (e.g., necessary temperature and pressure) of the special ink differs from those of regular ink. Finally, inventory control of special ink or watermarked paper against unauthorized use is usually not an easy task because the exact amount of remaining ink or paper is hard to manage.

In view of these and other issues, it would be highly desirable to have a technique enabling a thermal transfer printer to print images with some hidden security marks to avoid counterfeiting without using special ink or watermarked paper.

SUMMARY OF THE INVENTION

According to various embodiments of the present invention, a thermal transfer printer for transferring ink from an ink film to a printing medium has a print head, and a platen against which the print head is pressed during printing. The print head has a plurality of resistance heating elements operable to be individually energized with electrical drive pulses. Each of the resistance heating elements has a transfer surface which is substantially flat for transfer of the ink from the ink film to the printing medium. At least one of the transfer surfaces includes a concave portion which substantially avoids the transfer of the ink. A dot printed by a specific embodiment of the thermal transfer printer according to the present invention has an unprinted area. The unprinted area is not recognizable by the naked eye, but can be observable by using a magnifying device. Thus, the unprinted area in the dot printed by the thermal transfer printer functions as a watermark for determining authenticity of the printer.

In one specific embodiment, each of the plurality of resistance heating elements has the concave portion. In another specific embodiment, each of at least two of the transfer surfaces includes the concave portion, and each of the concave portions has a unique shape different from each other.

A further understanding of the nature and advantages of the present invention may be realized by reference to the remaining portions of the specification and the drawings.

BRIEF DESCRIPTION OF THE DRAWING

The invention, together with further objects and advantages thereof, may best be understood by reference to the following description taken in conjunction with the accompanying drawings in which.

DETAILED DESCRIPTION OF SPECIFIC EMBODIMENTS

Various embodiments of the present invention will now be described in detail with reference to the drawings, wherein like elements are referred to with like reference labels throughout.

Various embodiments of the present invention print images by utilizing a print head having heating elements, at least one of which has a concave portion on a transfer surface. Thus, ink corresponding to the concave portion is not heated by the heating element, thus avoiding transferring onto a printing medium. As a result, a single black dot printed by a heating element with the concave portion has a small unprinted area on the printing medium, which functions as a watermark. This unprinted mark as a watermark is so small to the extent that it is not visible without a magnifier, thereby avoiding counterfeiting.

Figure 1:
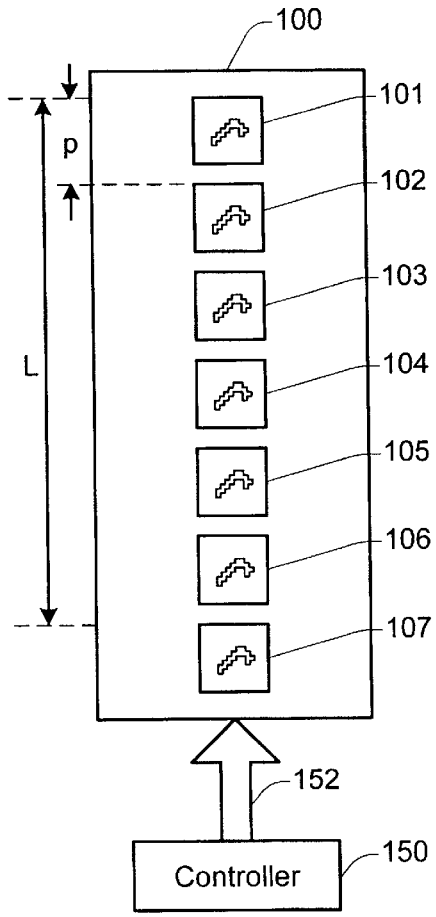
FIG. 1 is a plan view of a printing head used for a specific embodiment of a thermal transfer printer according to the present invention.

FIG. 1 is a plan view of a printing head 100 used for a specific embodiment of a thermal transfer printer according to the present invention. The printing head 100 has a plurality of resistance heating elements 101–107, which are operable to be individually energized with electrical drive pulses. A controller 150 generates the electrical drive pulses suitable for energizing the heating elements 101–107 based on image data representing the images to be printed on a printing medium, and applies the electrical drive pulses to the printing head 100 through a signal bus 152.

Although FIG. 1 shows only seven resistance heating elements for the sake of simplicity, the printing head 100 may have a different number of the heating elements. For example, the printing head 100 has 240 of the resistance heating elements 101. In FIG. 1, pitch p and length L are 1/600 inch and 0.4 inch, respectively. However, the pitch p and the length L may be selected to suit the requirements of resolution of the thermal transfer printer for which the printing head 100 is utilized.

Figure 2:
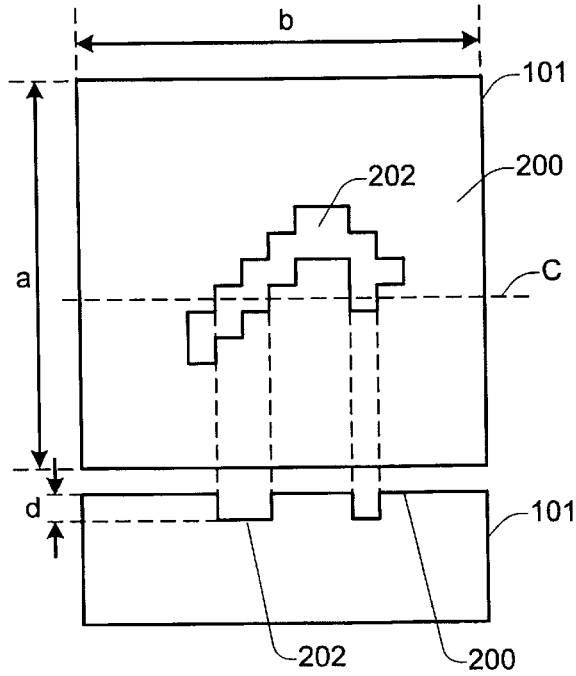
FIG. 2 is a plan view (upper) and a cross-sectional view (lower) taken along line C of the resistance heating element used for a specific embodiment of the thermal transfer printer according to the present invention.

FIG. 2 is a plan view (upper) and a cross-sectional view (lower) taken along line C of the resistance heating element 101 used for a specific embodiment of the thermal transfer printer according to the present invention. Although FIG. 2 shows only the resistance heating element 101, this structure of the resistance heating element 101 can be utilized for the other elements 102–107 in FIG. 1. Each of the resistance heating elements 101–107 shown in FIG. 1 has a transfer surface 200 which is substantially flat for transfer of ink from an ink film to a printing medium (e.g., paper).

Each of the resistance heating elements 101–107 has a concave portion 202. The concave portion 202 substantially avoids transfer of ink from an ink film to a printing medium, thus generating an unprinted area which functions as a watermark for identifying authenticity of the thermal transfer printer. In the specific embodiment shown in FIG. 2, lengths a and b are 1/630 inch, and depth d measured from the transfer surface 200 to the concave portion 202 is between about 0.001 mm and about 0.01 mm. In the specific embodiment of the present invention, an area of the concave portion 202 is between about 1% and about 25% of an area of the transfer surface 200. The transfer surface 200 of the specific embodiment shown in FIG. 2 includes aluminum. Alternatively, the transfer surface 200 may include silicon. The concave portion 202 is manufactured on the transfer surface 200 typically by chemical etching.

Figure 3:
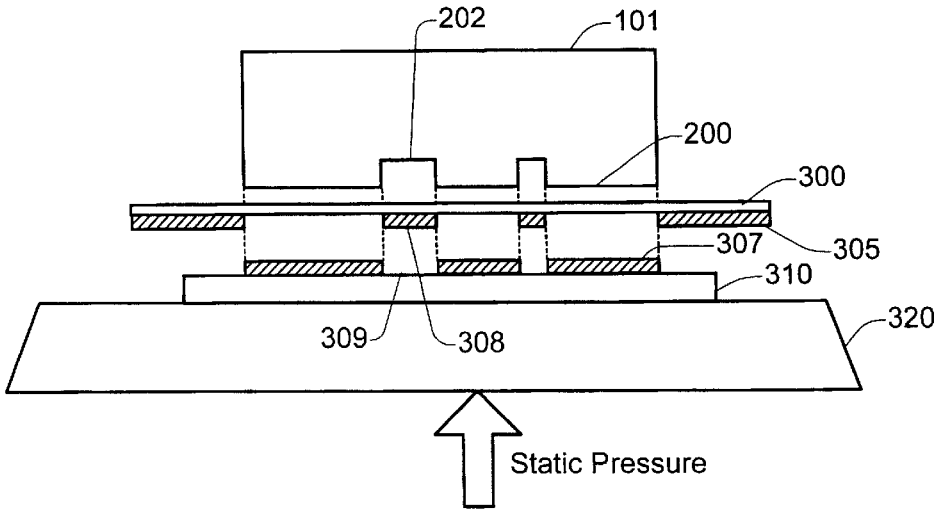
FIG. 3 shows a cross-sectional view of the resistance heating element, an ink film, a printing medium, and a platen used for a specific embodiment of the thermal transfer printer according to the printer invention taken along line C of FIG. 2.

FIG. 3 shows a cross-sectional view of the resistance heating element 101, an ink film 300, a printing medium 310, and a platen 320 used for a specific embodiment of the thermal transfer printer according to the printer invention taken along line C of FIG. 2. The ink film 300 has an ink layer 305 on the side which does not directly contact the transfer surface 200. During printing operation, the resistance heating element 101 is pressed against the platen 320 so that the ink layer 305 on the ink film 300 and the printing medium 310 are in direct contact.

When the resistance heating element 101 is heated, a printed area 307 of the ink layer 305 which is heated by the transfer surface 200 through the ink film 300 is melted and transferred from the ink film 300 to the printing medium 310. A portion 308 of the ink layer 305 which is not heated by the transfer surface 200 due to the existence of the concave portion 202 remains on the ink film 300, thus generating an unprinted area 309 which functions as a watermark. The unprinted area 309 on the printing medium 310 is made small to the extent that the area 309 cannot be observed by the naked eye, and can be observed using a magnifying device. Since the shape of the concave portion 202 is hard to reconstruct from the printed images, the unprinted area 309 identifies the authenticity of a printer which has the printing head 100 having the resistance heating elements 101–107 with the concave portion 202.

In the specific embodiment of the thermal transfer printer of the present invention shown in FIGS. 1 and 2, each of the resistance heating elements 101–107 has the concave portion 202 with an identical shape. However, in order to represent authenticity of a printer, the printing head 100 have only to provide at least one transfer surface 200 having the concave portion 202 which generates the unprinted area 309.

Typically, the printing medium 310 is regular paper, but may be any type of suitable printing medium such as a plastic film, a plastic card, a metal film, a metal card, or the like. Depending on the material used for the printing medium 310, the ink layer 305 may be selected appropriately. The pressure and temperature applied to the ink layer 305 and the printing medium 310, and the time for the application of the pressure and heat are suitably controlled by the controller 150 and associated transfer mechanisms of the thermal transfer printer according to the present invention.

Figure 4:
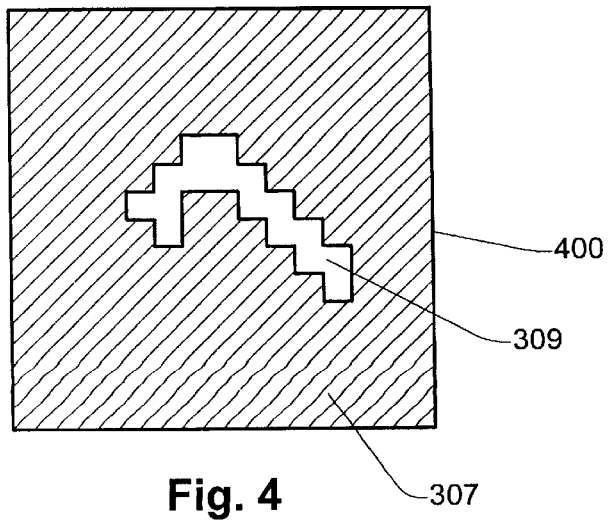
FIG. 4 is a plan view of a dot printed on the printing medium by the resistance heating element used for a specific embodiment of the thermal transfer printer according to the present invention.

FIG. 4 is a plan view of a dot 400 printed on the printing medium 310 by the resistance heating element 101 used for a specific embodiment of the thermal transfer printer according to the present invention. In the specific embodiment of the thermal transfer printer according to the present invention, the ratio of the unprinted area 309 to the printed area 307 ranges from about 1/99 to about 1/3. Thus, if observed by the naked eye, the dot 400 looks substantially filled by the color of the ink layer 305 transferred onto the printing medium 310.

Figure 5:
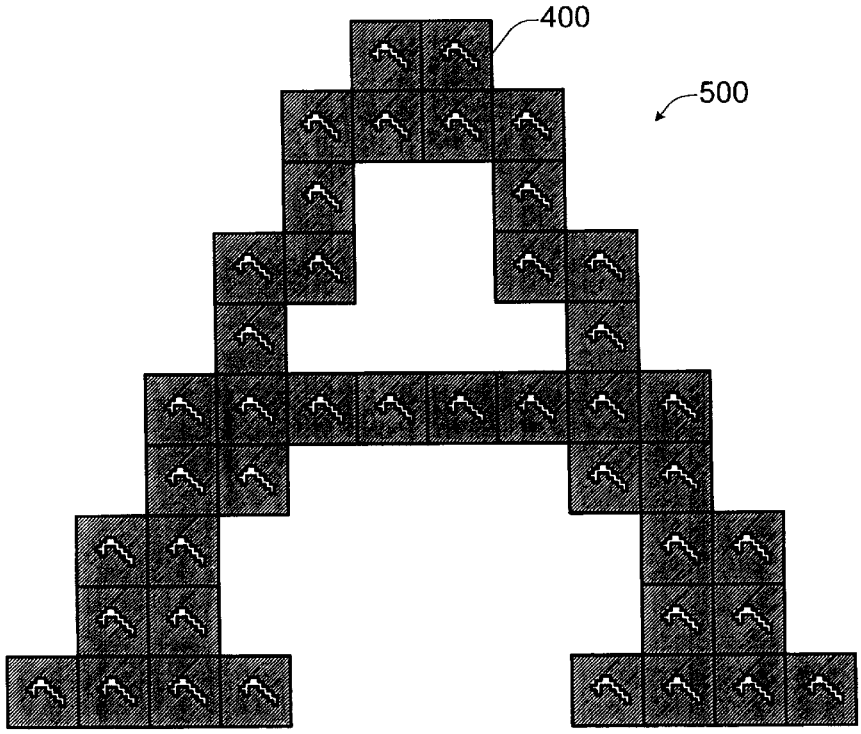
FIG. 5 is a plan view of a character printed by the thermal transfer printer using the printing head according to the present invention.

FIG. 5 is a plan view of a character 500 printed by the thermal transfer printer using the printing head 100 according to the present invention. The character 500 includes a plurality of dots 400, each of which includes the unprinted area 309. As a result, although a printer user is not able to recognize any difference from characters printed by a traditional printer, an optical magnifying device would allow one to determine whether the printed character 500 is printed by a printer which has the concave portion 202 on the transfer surface 200. Thus, use of such a device enables one to authenticate the printed document based on the unprinted area 309 which is "hidden" in the character 500.

Figure 6:
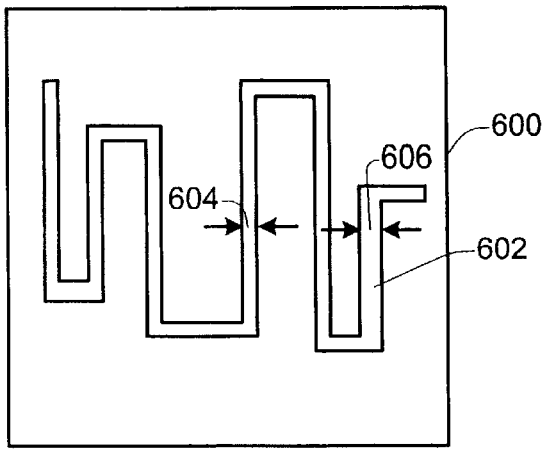
FIG. 6 is a plan view of a dot printed on the printing medium by the resistance heating element used for a specific embodiment of the thermal transfer printer according to the present invention.

FIG. 6 is a plan view of a dot 600 printed on the printing medium 310 by the resistance heating element 101 used for a specific embodiment of the thermal transfer printer according to the present invention. In the specific embodiment of the thermal transfer printer according to the present invention, a shape of a concave portion 602 corresponding to the concave portion 202 includes a meander line. In a further specific embodiment of the present invention, the shape of the concave portion 602 includes at least two line portions with different widths 604 and 606. This width difference in the concave portion 602 makes it more difficult to exactly reproduce the resistance heating elements 101–107 from the printed image of the dot 600, thus avoiding counterfeiting a document by unauthorized reproduction of the printer.

Figure 7:
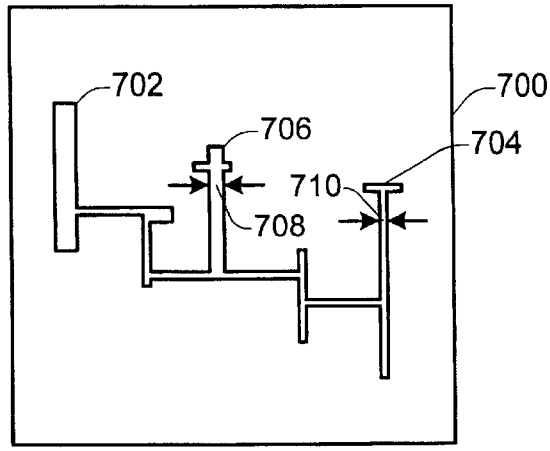
FIG. 7 is a plan view of a dot printed on the printing medium by the resistance heating element used for a specific embodiment of the thermal transfer printer according to the present invention.

FIG. 7 is a plan view of a dot 700 printed on the printing medium 310 by the resistance heating element 101 used for a specific embodiment of the thermal transfer printer according to the present invention. In the specific embodiment of the thermal transfer printer according to the present invention, a shape of a concave portion 702 corresponding to the concave portion 202 includes one or more branches 704 and 706. In a further specific embodiment of the present invention, the shape of the concave portion 702 includes at least two line portions with different widths 708 and 710. This width difference in the concave portion 702 makes it more difficult to exactly reproduce the resistance heating elements 101–107 from the printed image of the dot 700, thus avoiding counterfeiting a document by unauthorized reproduction of the printer.

Figure 8:
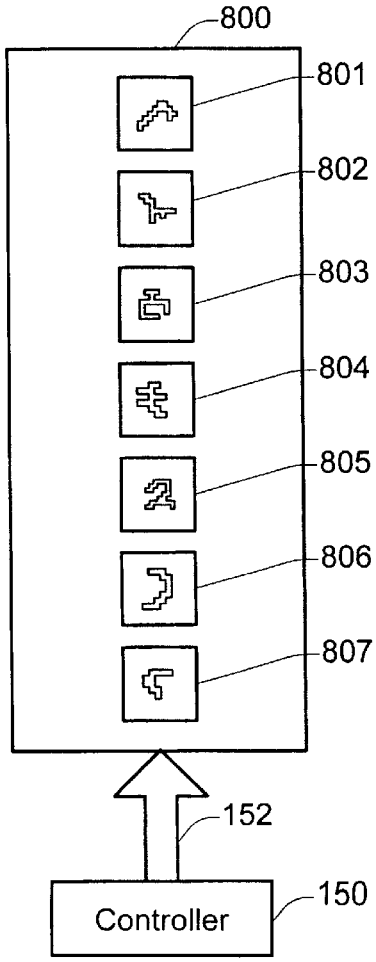
FIG. 8 is a plan view of a printing head used for a further specific embodiment of a thermal transfer printer according to the present invention.

FIG. 8 is a plan view of a printing head 800 used for a further specific embodiment of a thermal transfer printer according to the present invention. The printing head 800 has a plurality of resistance heating elements 801–807, which are operable to be individually energized with electrical drive pulses generated by the controller 150. In the specific embodiment shown in FIG. 8, each of the resistance heating elements 801–807 has a unique shape different from each other. As a result, compared to the printing head 100, it is more difficult and time-consuming to exactly reproduce the resistance heating elements 801–807 from dots printed by the printing head 800, thus increasing security against counterfeiting a document by unauthorized reproduction of the printing head 100.

Alternatively, the printing head 800 has at least two transfer surfaces 200 each of which has the concave portion 202, and each concave portion 202 has a unique shape different from each other. In this alternative embodiment, the transfer surfaces 200 other than the two or more transfer surfaces which have the concave portions 202 do not have to provide the concave portions 202. This alternative embodiment of the thermal transfer printer according to the present invention enables relatively high security against reproduction of the printing head 100 and relatively simple manufacturing process for the concave portion 202.

In another specific embodiment of the present invention, the printing heads 100 and 800 are used for a thermal printer printing images on thermal paper. In such a case, the thermal printer applies heat to the thermal paper, which is heat-sensitive, and no ink film is necessary.

The above-described specific embodiment uses the printing heads 100 and 800 which print images on the printing medium 310 in black. However, those skilled in the art will appreciate that the color printed by the printing heads 100 and 800 may be any other color suitable for the printing medium 310.

In some specific embodiments, a shape of the concave portion 202 may be determined based on data representing an identification code of the printer so that analysis of the shape of the unprinted area 309 enables identification of the printer used. The identification code of the printer may include alphanumeric characters. Alternatively, the identification code of the printer is an encoded version of the identification code of the printer by utilizing encryption techniques.

Although only a few embodiments of the present invention have been described in detail, it should be understood that the present invention may be embodied in many other specific forms without departing from the spirit or scope of the invention. For example, the illustrated embodiments have been described primarily in the context of an ECR system, it should be appreciated that various printers or devices including a printer may include the direct thermal printing mechanism and the ink printing mechanism. Therefore, it should be apparent that the above described embodiments are to be considered as illustrative and not restrictive, and the invention is not to be limited to the details given herein, but may be modified within the scope of the appended claims.

What is claimed is:

1. A thermal printer for transferring ink from an ink film to a printing medium, comprising:

a print head having a plurality of resistance heating elements operable to be individually energized with electrical drive pulses, each of the resistance heating elements having a transfer surface which is substantially flat for transfer of the ink from the ink film to the printing medium; and a platen against which the print head is pressed during printing, wherein at least one of the transfer surfaces includes a concave portion which substantially avoids the transfer of the ink.

2. The thermal printer of claim 1, wherein each of the plurality of resistance heating elements has the concave portion.

3. The thermal printer of claim 1, wherein each of at least two of the transfer surfaces includes the concave portion, and each of the concave portion has a unique shape different from each other.

4. The thermal printer of claim 1, wherein an area of the concave portion is between about 1% and about 25% of an area of the transfer surface.

5. The thermal printer of claim 1, wherein the concave portion has a depth from the transfer surface of about 0.001 mm to about 0.01 mm.

6. The thermal printer of claim 1, wherein the transfer surfaces include aluminum.

7. The thermal printer of claim 1, wherein the transfer surfaces include silicon.

8. The thermal printer of claim 1, wherein a shape of the concave portion includes a meander line.

9. The thermal printer of claim 8, wherein a shape of the concave portion includes at least two line portions with different widths.

10. The thermal printer of claim 1, wherein a shape of the concave portion includes a branch.

11. The thermal printer of claim 10, wherein a shape of the concave portion includes at least two line portions with different widths.

12. A method for transferring ink from an ink film to a printing medium, comprising:

providing a print head having a plurality of resistance heating elements operable to be individually energized with electrical drive pulses, each of the resistance heating elements having a transfer surface which is substantially flat for transfer of the ink from the ink film to the printing medium;

providing a platen against which the print head is pressed during printing; and pressing the print head against the platen, wherein at least one of the transfer surfaces includes a concave portion which substantially avoids the transfer of the ink.

* * * * *